US010388453B2

(12) United States Patent
Igarashi et al.

(10) Patent No.: US 10,388,453 B2
(45) Date of Patent: Aug. 20, 2019

(54) COIL COMPONENT

(71) Applicant: MURATA MANUFACTURING CO., LTD., Kyoto-fu (JP)

(72) Inventors: Akio Igarashi, Nagaokakyo (JP); Koji Onishi, Nagaokakyo (JP); Takashi Murakami, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 123 days.

(21) Appl. No.: 15/481,058

(22) Filed: Apr. 6, 2017

(65) Prior Publication Data

US 2017/0345557 A1 Nov. 30, 2017

(30) Foreign Application Priority Data

May 26, 2016 (JP) ..... 2016-104828

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 5/06*** | (2006.01) |
| ***H01F 17/04*** | (2006.01) |

(52) U.S. Cl.

CPC ..... *H01F 27/292* (2013.01); *H01F 5/06* (2013.01); *H01F 17/04* (2013.01); *H01F 27/2823* (2013.01); *H01F 27/2828* (2013.01); *H01F 27/32* (2013.01)

(58) Field of Classification Search

CPC ..... H01F 27/292; H01F 17/045; H01F 27/24; H01F 27/2823

USPC ..... 336/65, 83, 90, 192, 208

See application file for complete search history.

(56) References Cited

U.S. PATENT DOCUMENTS

2006/0267719 A1* 11/2006 Yasuda ..... H01F 17/045 336/223
2008/0003864 A1* 1/2008 Hatakeyama ..... H01F 17/045 439/399

FOREIGN PATENT DOCUMENTS

| | | | |
|---|---|---|---|
| JP | S59-42009 U | | 3/1984 |
| JP | S62-70421 U | | 5/1987 |
| JP | 05291029 A | * | 11/1993 |
| JP | 2004014671 A | * | 1/2004 |

(Continued)

OTHER PUBLICATIONS

An Office Action; "Notification of Reasons for Refusal," Mailed by the Japanese Patent Office dated Nov. 20, 2018, which corresponds to Japanese Patent Application No. 2016-104828 and is related to U.S. Appl. No. 15/481,058; with English language translation.

*Primary Examiner* — Tszfung J Chan

(74) *Attorney, Agent, or Firm* — Studebaker & Brackett PC

(57) ABSTRACT

A coil component including a wire has a central conductor and an insulating coating layer, and a terminal electrode has a connection part that is electrically connected to the central conductor. The connection part includes a receiving part that receives an end portion of the wire, and a welding part that extends from the receiving part via a fold-back part so as to face the receiving part. The wire becomes sandwiched between the receiving part and the welding part. The central conductor is welded to the welding part in the portion from which the insulating coating layer is removed. The distal end portion of the wire protrudes from the space between the receiving part and the welding part, with the insulating coating layer remaining on the distal end portion.

5 Claims, 8 Drawing Sheets

(56) References Cited

FOREIGN PATENT DOCUMENTS

| | | | | | |
|---|---|---|---|---|---|
| JP | 2005056934 | A | * | 3/2005 | ..... H01F 17/045 |
| JP | 2006278593 | A | * | 10/2006 | |
| JP | 2008-10753 | A | | 1/2008 | |
| JP | 4184394 | B2 | | 11/2008 | |

* cited by examiner

COIL COMPONENT

CROSS REFERENCE TO RELATED APPLICATIONS

This application claims benefit of priority to Japanese Patent Application 2016-104828 filed May 26, 2016, the entire content of which is incorporated herein by reference.

TECHNICAL FIELD

The present disclosure relates to a coil component having a substantially helical wire, and more specifically to the structure of the connection between the wire and a terminal electrode.

BACKGROUND

An example of a technique that is of interest for the present disclosure is described in Japanese Patent No. 4184394. FIGS. 8, 9, and 10, which are cited from Japanese Patent No. 4184394, respectively correspond to FIGS. 2, 4, and 5 in Japanese Patent No. 4184394. FIGS. 8 to 10 depict the following components: a flange 1, which constitutes a part of a core included in a coil component, a terminal electrode 2 positioned on the flange 1, and an end portion of a wire 3 connected to the terminal electrode 2.

As illustrated in FIGS. 8 and 10, the wire 3 includes a central conductor 4 having a substantially linear shape, and an insulating coating layer 5 that covers the peripheral surface of the central conductor 4. The terminal electrode 2 has a base 7, and a receiving part 9. The base 7 is positioned on the same side as an outer end face 6 of the flange 1. The receiving part 9 extends from the base 7 via a bending part 8, and receives an end portion of the wire 3. The terminal electrode 2 further includes a welding part 11, and a holding part 13. The welding part 11 extends from the receiving part 9 via a first fold-back part 10, and is to be welded to the central conductor 4 of the wire 3. The holding part 13 extends from the receiving part 9 via a second fold-back part 12 to hold and position the wire 3 in place.

The state of the welding part 11 prior to undergoing a welding step, and the state of the welding part 11 after undergoing the welding step are respectively illustrated in FIG. 8 and FIGS. 9 and 10. A weld ball 14 formed as a result of this welding is illustrated in FIGS. 9 and 10.

The welding step is performed as follows. Prior to the welding step, the welding part 11 and the holding part 13 of the terminal electrode 2 are in their unfolded state with respect to the receiving part 9, and are not facing the receiving part 9. FIG. 8 depicts a state in which, although the holding part 13 is facing the receiving part 9, the welding part 11 is in its unfolded state with respect to the receiving part 9.

First, the wire 3 is placed on the receiving part 9 of the terminal electrode 2. To temporarily secure the wire 3 in this state, the holding part 13 is folded toward the receiving part 9 at the second fold-back part 12 such that the wire 3 becomes sandwiched between the receiving part 9 and the holding part 13.

Next, as illustrated in FIG. 8, the insulating coating layer 5 is removed in the portion of the wire 3 located closer to the distal end of the wire 3 relative to the holding part 13. At this time, for example, laser beam irradiation is employed to remove the insulating coating layer 5. As clearly depicted also in FIG. 10, the portion of the insulating coating layer 5 in contact with the receiving part 9 is allowed to remain unremoved.

Next, the welding part 11 is folded toward the receiving part 9 at the first fold-back part 10, causing the wire 3 to become sandwiched between the welding part 11 and the receiving part 9.

Next, the central conductor 4 of the wire 3 and the welding part 11 are welded together. More specifically, laser welding is performed. A laser beam is applied to the welding part 11, causing the central conductor 4 of the wire 3 and the welding part 11 to melt into each other, thus welding the central conductor 4 and the welding part 11 together.

SUMMARY

During the welding step, as the welding part 11 of the terminal electrode 2 and the central conductor 4 of the wire 3 melt and liquefy as described above, the resulting surface tension causes the shape of the molten portion to approach a sphere. As a result, the weld ball 14 is formed as described above. When the welding part 11 of the terminal electrode 2 and the central conductor 4 of the wire 3 melt and liquefy, this can cause molten metal 15 to spread out of the receiving part 9 of the terminal electrode 2 and reach the bending part 8 or the base 7 as indicated by the blackened portion in FIG. 11.

Excessive welding, such as one that causes the molten metal 15 to spread out of the receiving part 9 of the terminal electrode 2 and reach the bending part 8 or the base 7, can adversely affect the terminal electrode 2. For example, this can cause undesired melting or deformation to occur in a portion of the bending part 8 of the terminal electrode 2, which can make it impossible for the terminal electrode 2 to function properly.

It is accordingly an object of the present disclosure to provide a coil component with a structure that can reduce the above-mentioned excessive welding.

One embodiment of the present disclosure is directed to a coil component including a wire having a substantially helical shape, and a terminal electrode. The wire includes a central conductor having a substantially linear shape, and an insulating coating layer that covers the peripheral surface of the central conductor. The terminal electrode has a connection part that is electrically connected to the central conductor in an end portion of the wire.

The connection part of the terminal electrode includes a receiving part that receives the end portion of the wire, and a welding part that extends from the receiving part via a fold-back part so as to face the receiving part. The wire becomes sandwiched between the receiving part and the welding part. The central conductor of the wire is welded to the welding part in a portion from which the insulating coating layer is removed.

In the coil component configured as described above, the distal end portion of the wire protrudes from the space between the receiving part and the welding part, with the insulating coating layer remaining at least on an area of the distal end portion opposite to the area in contact with the receiving part.

Employing the above-mentioned characteristic configuration ensures that, when the welding part of the terminal electrode and the central conductor of the wire melt and liquefy, and the resulting liquefied metal is about to spread out of the receiving part of the terminal electrode, the liquefied metal is repelled by the insulating coating layer protruding from the space between the receiving part and the welding part and covering the distal end portion of the wire.

According to another embodiment of the present disclosure, the insulating coating layer remains on the entire periphery of the distal end portion of the wire. This configuration ensures that the liquefied metal is repelled by the insulating coating layer that covers the distal end portion of the wire.

According to another embodiment of the present disclosure, the insulating coating layer of the wire is present not only in the distal end portion of the wire but also in a portion of the wire in contact with the receiving part. The insulating coating layer that is present in the portion of the wire in contact with the receiving part also serves to reduce excessive welding.

The coil component according to another embodiment of the present disclosure may not include a core. However, if the coil component includes a core, the core has a core part and a flange provided in an end portion of the core part. The wire is wound around the core part in a substantially helical manner.

According to another embodiment of the present disclosure, the flange includes a bottom face oriented toward a mount board when the coil component is mounted onto the mount board. The terminal electrode is disposed such that at least a part of the terminal electrode extends along the bottom face. This configuration allows the coil component to be constructed as a surface-mount coil component.

According to another embodiment of the present disclosure, the insulating coating layer is made of a material capable of withstanding a temperature that is applied to the insulating coating layer when the central conductor and the welding part are welded to each other. This configuration prevents undesired melting or disintegration of the portion of the insulating coating layer that needs to remain.

The coil component according to one embodiment of the present disclosure has a structure such that the liquefied metal generated when the welding part of each of the terminal electrodes and the central conductor of the wire melt can be repelled by the insulating coating layer that covers the distal end portion of the wire. This reduces undesired deformation or melting that occurs in the terminal electrode as a result of excessive welding.

Other features, elements, characteristics and advantages of the present disclosure will become more apparent from the following detailed description with reference to the attached drawings.

BRIEF DESCRIPTION OF THE DRAWINGS

FIGS. 1A and 1B are external perspective views of a coil component according to a first embodiment of the present disclosure, of which FIG. 1A is a view seen from a relatively upper position above the coil component, and FIG. 1B is a view seen from a relatively lower position below the coil component.

FIGS. 5A and 5B are sectional views of the portion illustrated in FIG. 4, of which FIG. 5A is a sectional view taken along a line 1-1 in FIG. 4, and FIG. 5B is a sectional view taken along a line 2-2 in FIG. 4.

FIGS. 6A and 6B are perspective views of a coil component according to a second embodiment of the present disclosure, illustrating only a core and terminal electrodes with an illustration of wires included in the coil component being omitted, of which FIG. 6A is a view seen from a relatively upper position above the coil component, and FIG. 6B is a view seen from a relatively lower position below the coil component.

FIGS. 7A and 7B are external perspective views of a coil component according to a third embodiment of the present disclosure, of which FIG. 7A is a view seen from a relatively upper position above the coil component, and FIG. 7B is a view seen from a relatively lower position below the coil component.

DETAILED DESCRIPTION

Figure 1A:
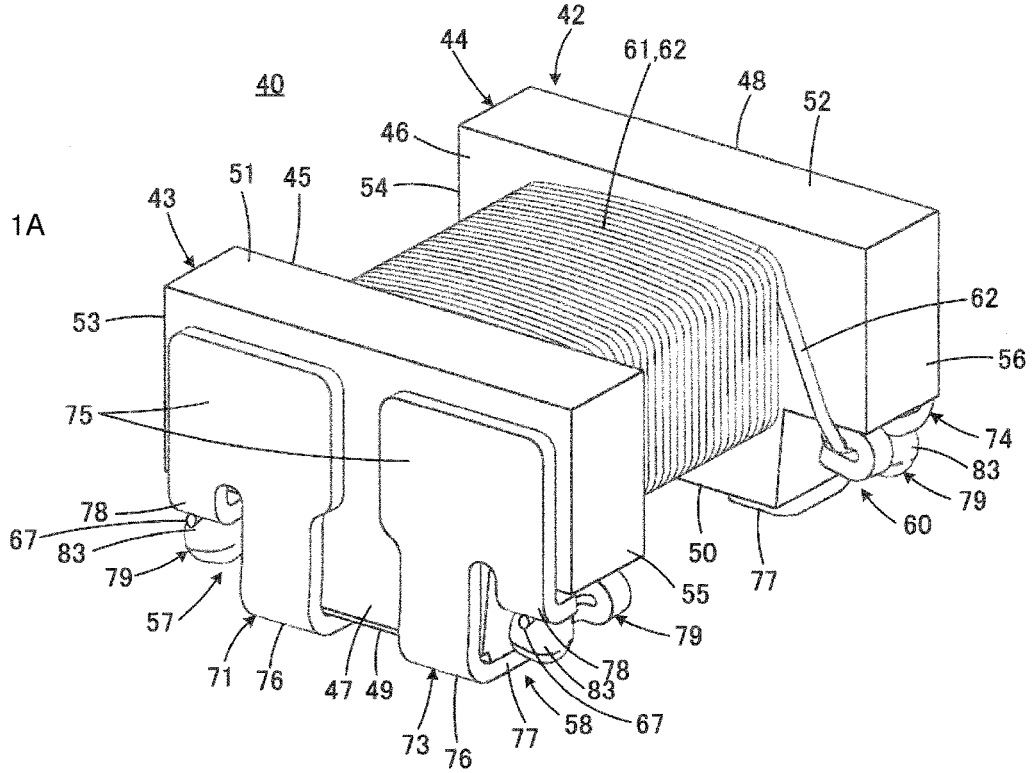
Figure 1B:
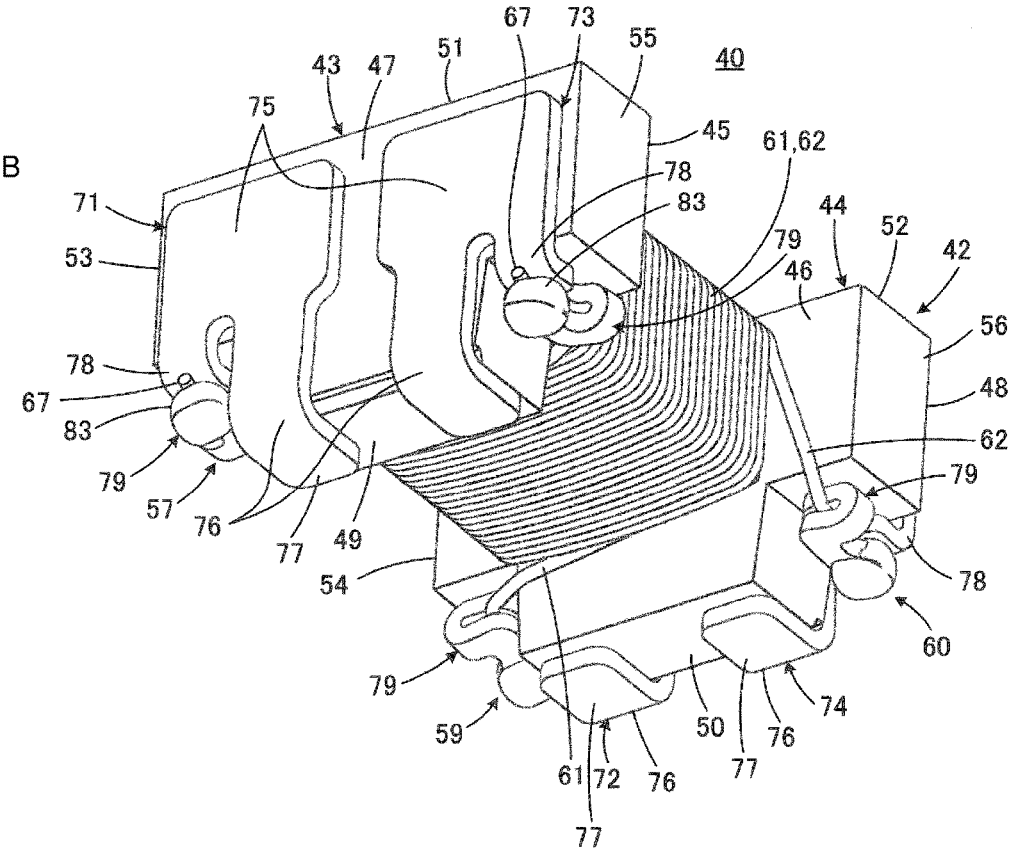

A coil component 40 according to a first embodiment of the present disclosure will be described with reference to FIG. 1A to FIG. 5B. More specifically, the coil component 40 illustrated in these figures forms a common mode choke coil, which is an example of a coil component.

The coil component 40 includes a core 42 with a substantially drum-like shape that has a core part 41. The core 42 includes first and second flanges 43 and 44 each provided at an end portion of the core part 41. The core 42 is made of, for example, a magnetic material such as ferrite. Although it is inferred from FIGS. 1A and 1B that the core part 41 has the shape of a substantially quadrangular prism, the core part 41 may alternatively have a substantially cylindrical or polygonal prism shape.

The flanges 43 and 44 respectively have inner end faces 45 and 46 facing toward the core part 41 and where both end portions of the core part 41 are positioned, and outer end faces 47 and 48 located opposite to the inner end faces 45 and 46 and facing outward. Further, the flanges 43 and 44 respectively have bottom faces 49 and 50 that are oriented toward a mount board (not illustrated) when the coil component 40 is mounted onto the mount board, top faces 51 and 52 located opposite to the bottom faces 49 and 50, first side faces 53 and 54, and second side faces 55 and 56 that are opposite to the first side faces 53 and 54.

In the first flange 43, the bottom face 49, the top face 51, the first side face 53, and the second side face 55 each connect the inner end face 45 with the outer end face 47. The first side face 53 and the second side face 55 extend so as to connect the bottom face 49 with the top face 51.

Likewise, in the second flange 44, the bottom face 50, the top face 52, the first side face 54, and the second side face 56 each connect the inner end face 46 with the outer end face 48. The first side face 54 and the second side face 56 extend so as to connect the bottom face 50 with the top face 52.

The first flange 43 has depressions 57 and 58 in the form of cutouts respectively located in end portions of the first and second side faces 53 and 55 near the bottom face 49.

Likewise, the second flange 44 has depressions 59 and 60 in the form of cutouts respectively located in end portions of the first and second side faces 54 and 56 near the bottom face 50.

Figure 3:
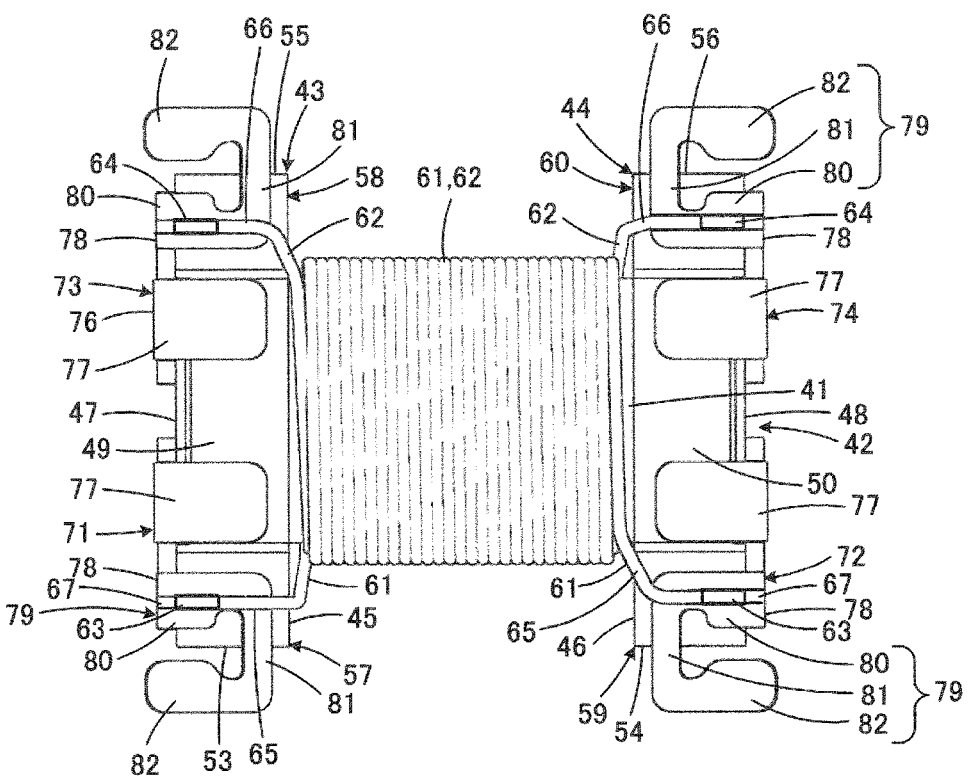
FIG. 3 is a bottom view corresponding to FIG. 2, illustrating a state prior to welding wires to terminal electrodes.
Figure 4:
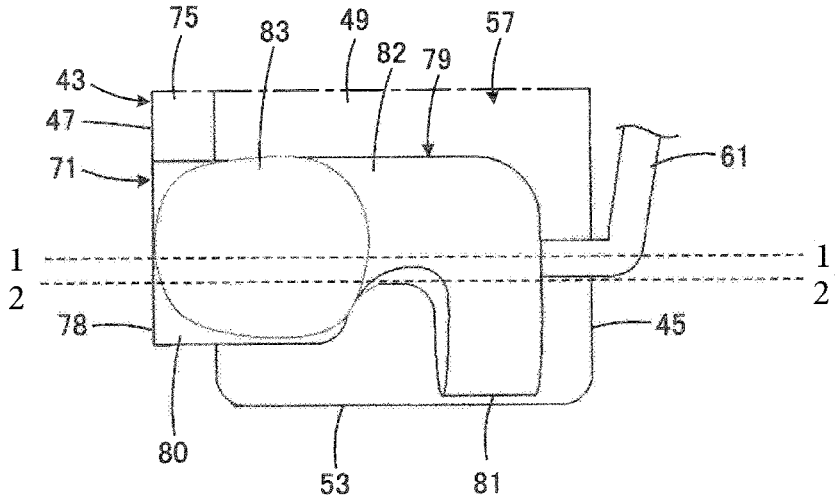
FIG. 4 is an enlarged bottom view of the portion in the vicinity of a terminal electrode of the coil component illustrated in FIG. 1.
Figure 5A:
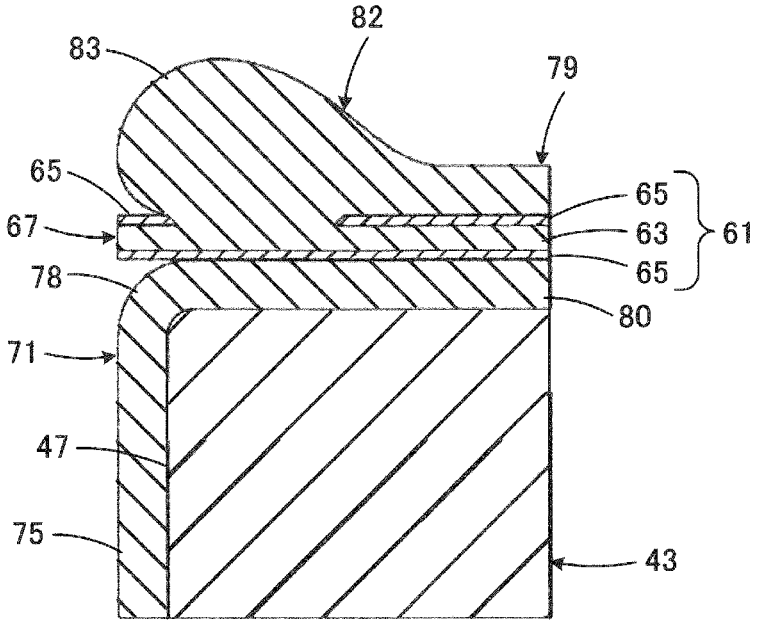
Figure 5B:
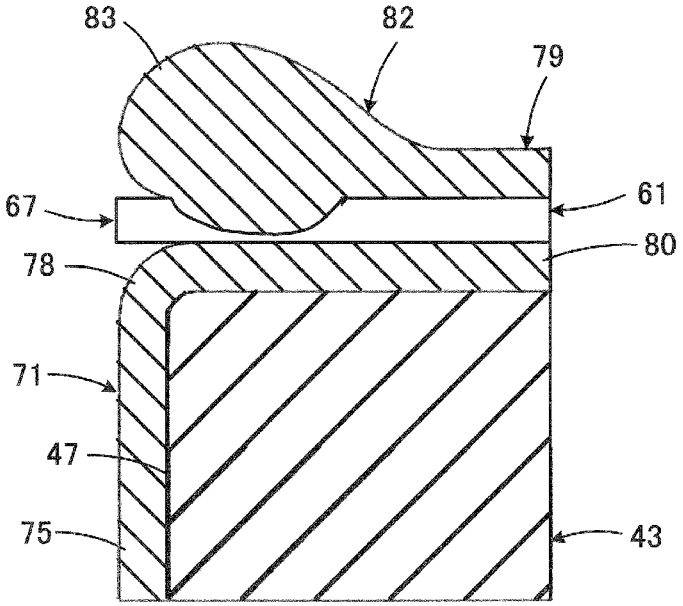

The coil component 40 further includes first and second wires 61 and 62 wound on the core part 41 in a substantially helical manner. As illustrated in FIGS. 3, 5A, and 5B, the wires 61 and 62 respectively include central conductors 63 and 64 having a substantially linear shape, and insulating coating layers 65 and 66 that cover the peripheral surfaces of the central conductors 63 and 64. The central conductors 63 and 64 are each formed by, for example, a copper wire. The insulating coating layers 65 and 66 are made of a material capable of withstanding temperatures applied to the insulating coating layers 65 and 66 in a welding step described later, for example, resin such as polyurethane, polyimide, polyester imide, or polyamidoimide.

If the coil component 40 is a common mode choke coil, the wires 61 and 62 are wound in the same direction. At this time, the wires 61 and 62 may be either wound in a two-layer fashion such that one of the wires is located on the inner layer side and the other is located on the outer layer side, or wound in a bifilar fashion such that the wires are arranged alternately and wound in parallel to each other in the axial direction of the core part 41.

The coil component 40 further includes first to fourth terminal electrodes 71 to 74. Among the first to fourth terminal electrodes 71 to 74, the first and third terminal electrodes 71 and 73 are fixed to the first flange 43 by using an adhesive. The second and fourth terminal electrodes 72 and 74 are fixed to the second flange 44 by using an adhesive.

The first terminal electrode 71 and the fourth terminal electrode 74 are substantially identical in shape, and the second terminal electrode 72 and the third terminal electrode 73 are substantially identical in shape. The first terminal electrode 71 and the third terminal electrode 73 are substantially plane symmetric, and the second terminal electrode 72 and the fourth terminal electrode 74 are substantially plane symmetric. Accordingly, one of the first to fourth terminal electrodes 71 to 74, for example, the first terminal electrode 71 will be described in detail below, and a detailed description of the second, third, and fourth terminal electrodes 72, 73, and 74 will not be provided.

The terminal electrode 71 is normally manufactured by, for example, applying sheet metal working to a single metal sheet made of a copper-based alloy such as phosphor bronze or tough pitch copper. However, the terminal electrode 71 may be manufactured by another method, for example, casting.

The terminal electrode 71 includes a base 75 and a mounting part 77. The base 75 extends along the outer end face 47 of the flange 43. The mounting part 77 extends from the base 75 along the bottom face 49 of the flange 43 via a first bending part 76 that covers the edge portion where the outer end face 47 and the bottom face 49 of the flange 43 meet. That is, the base 75 is positioned on the same side as the outer end face 47 of the flange 43, and the mounting part 77 extends via the first bending part 76 so as to be positioned on the same side as the bottom face 49 of the flange 43.

Further, the terminal electrode 71 has a connection part 79 that extends from the base 75 via a second bending part 78. The connection part 79 includes a receiving part 80 and a welding part 82. The receiving part 80 receives an end portion of the wire 61. The welding part 82 extends from the receiving part 80 via a fold-back part 81 so as to overlap the receiving part 80, and is welded to an end portion of the wire 61. The connection part 79 is positioned within the depression 57 provided in the first flange 43.

As described above, the connection part 79 has both the function of receiving and positioning the wire 61 and the function of welding the wire 61.

Reference signs 75, 76, 77, 78, 79, 80, 81, and 82 respectively used to designate the base, first bending part, mounting part, second bending part, connection part, receiving part, fold-back part, and welding part of the first terminal electrode 71 are also respectively used to designate the corresponding first bending part, mounting part, second bending part, connection part, receiving part, fold-back part, and welding part of each of the second, third, and fourth terminal electrodes 72, 73, and 74.

One end of the first wire 61 is connected to the first terminal electrode 71, and the other end of the first wire 61 is connected to the second terminal electrode 72. One end of the second wire 62 is connected to the third terminal electrode 73, and the other end of the second wire 62 is connected to the fourth terminal electrode 74. As a representative example, the process of connecting the first wire 61 to the first terminal electrode 71 will be described below.

Prior to connection of the wire 61, in the connection part 79, the welding part 82 of the terminal electrode 71 is in its unfolded state with respect to the receiving part 80 as illustrated in FIG. 3. In this state, the end portion of the wire 61 is positioned on the receiving part 80 of the terminal electrode 71.

Next, the wire 61 is temporarily fixed to the receiving part 80. For example, the insulating coating layer 65 of the wire 61 is heated to soften, followed by application of a load to the resulting insulating coating layer 65. This brings the wire 61 into close contact with the receiving part 80, thus temporarily fixing the wire 61 to the receiving part 80. At this time, the wire 61 is positioned such that at the point when a welding step described later is finished, a distal end portion 67 of the wire 61 protrudes from the space between the receiving part 80 and the welding part 82.

Next, the wire 61 is irradiated with a laser beam to remove the insulation coating layer 65 on the area of the wire 61 opposite to the area in contact with the receiving part 80, thus exposing the central conductor 63 of the wire 61. FIG. 3 illustrates a state in which the central conductor 63 of the wire 61 is exposed. As is apparent from FIG. 3, the insulating coating layer 65 remains on the distal end portion 67 of the wire 61.

Next, as can be inferred from FIGS. 1A and 1B, 2, and 4, the fold-back part 81 is folded such that the welding part 82 faces and overlaps the receiving part 80 with the end portion of the wire 61 sandwiched therebetween, thus bringing the welding part 82 into close proximity or contact with the exposed central conductor 63.

Next, a laser beam is applied to the welding part 82, thus welding the welding part 82 and the exposed central conductor 63 of the wire 61 together. A weld ball 83 formed as a result of this laser welding is illustrated in FIGS. 1A and 1B, 2, 4, and 5A and 5B.

As clearly depicted in FIGS. 5A and 5B, at the point when the above-mentioned welding step is finished, the distal end portion 67 of the wire 61 protrudes from the space between the receiving part 80 and the welding part 82. At this time, it suffices if the distal end portion 67 protrudes from the above-mentioned space when the coil component 40 is viewed from the front as illustrated in FIGS. 5A and 5B.

Figure 2:
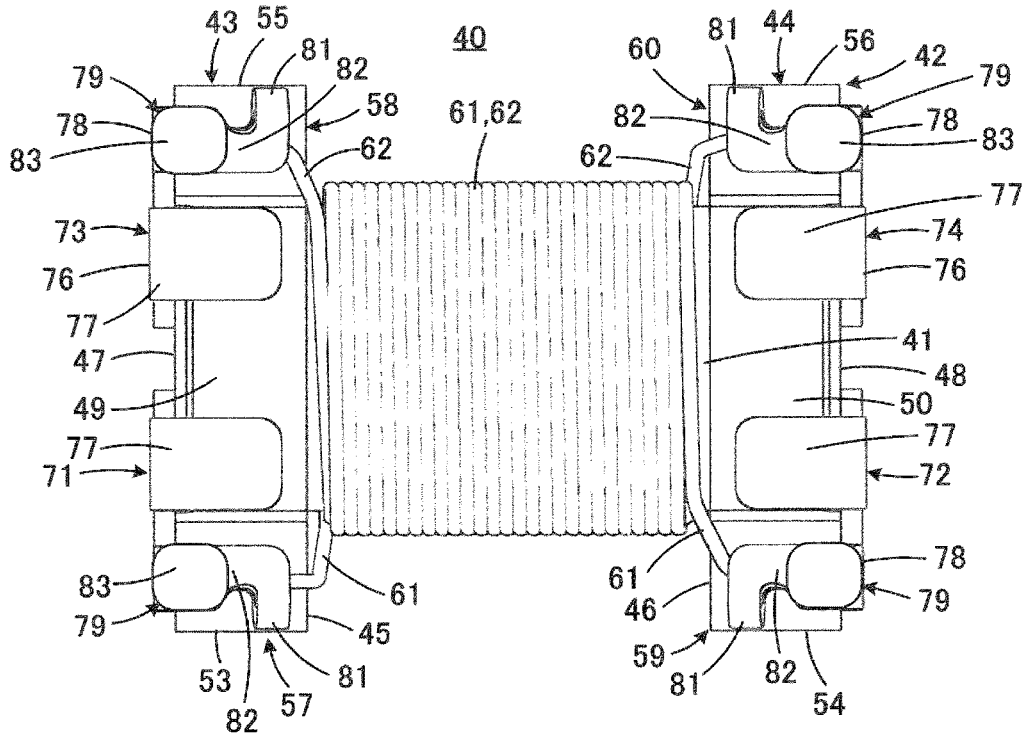
FIG. 2 is an external bottom view of the coil component illustrated in FIG. 1.

Accordingly, for example, the distal end portion 67 of the wire 61 may not need to be visible when the coil component 40 is viewed from the bottom as illustrated in FIG. 2.

At the point when the welding step is finished, the insulating coating layer 65 still remains on the distal end portion 67 of the wire 61. Although the insulating coating layer 65 preferably remains on the entire periphery of the central conductor 63, it suffices if the insulating coating layer 65 remains at least on the area opposite to the area in contact with the receiving part 80. To ensure that the insulating coating layer 65 remains as described above, the insulating coating layer 65 is preferably made of a material capable of withstanding temperatures applied to the insulating coating layer 65 in the welding step as described above.

As described above, the distal end portion 67 of the wire 61 protrudes from the space between the receiving part 80 and the welding part 82, with the insulating coating layer 65 remaining at least on an area of the distal end portion 67 opposite to the area in contact with the receiving part 80. This configuration ensures that, when the welding part 82 and the central conductor 63 of the wire 61 melt and liquefy, and the resulting liquefied metal is about to spread out of the receiving part 80, the liquefied metal is repelled by the insulating coating layer 65 that covers the distal end portion of the wire 61. This reduces undesired deformation or melting that occurs in the terminal electrode 71 as a result of excessive welding.

The above completes the process of connecting the first wire 61 to the first terminal electrode 71. The same process is performed for the second, third, and fourth terminal electrodes 72, 73, and 74 to complete the coil component 40 illustrated in FIGS. 1A, 1B, and 2. Although laser welding is used for the connection between the welding part 82 and the central conductor 63 of the wire 61 in the foregoing description, this is not to be construed respectively. Other methods such as arc welding may be used for the connection.

Although not illustrated in FIGS. 1A to 3, the coil component 40 may be provided with a plate core that is passed between the pair of flanges 43 and 44 with its one principal face being in contact with the respective top faces 51 and 52 of the first and second flanges 43 and 44. In this case, if the drum-shaped core 42 and the plate core are both made of a magnetic material such as ferrite, the drum-shaped core 42 and the plate core form a closed magnetic circuit.

Figure 6A:
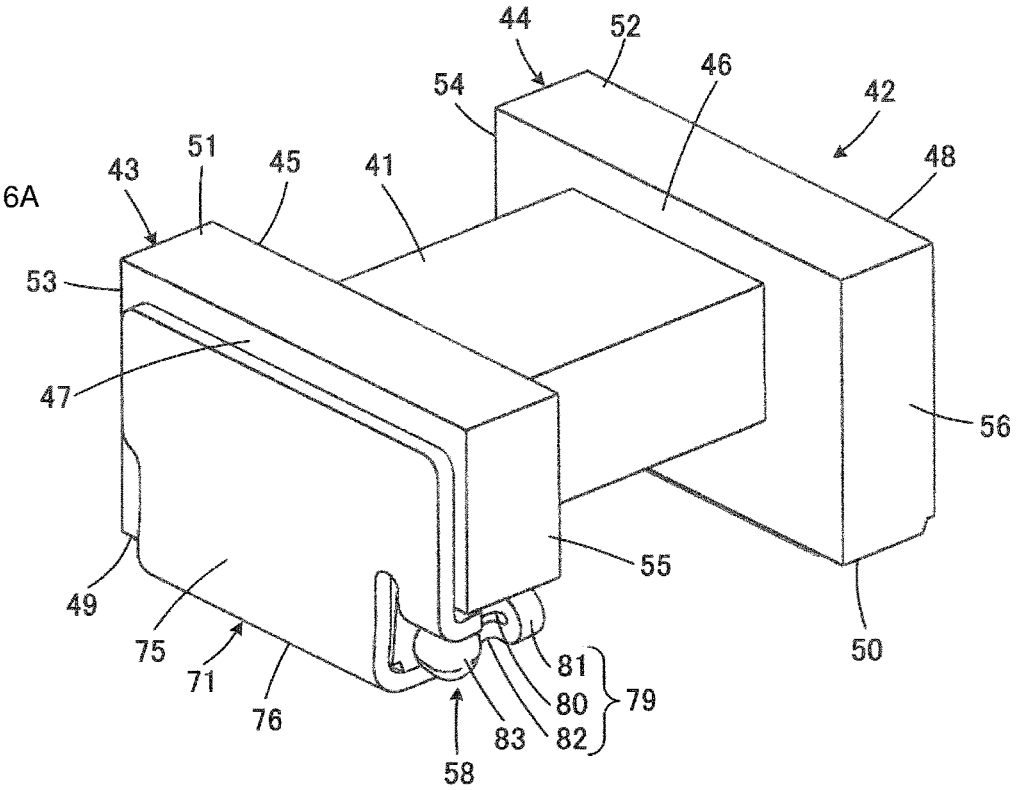
Figure 6B:
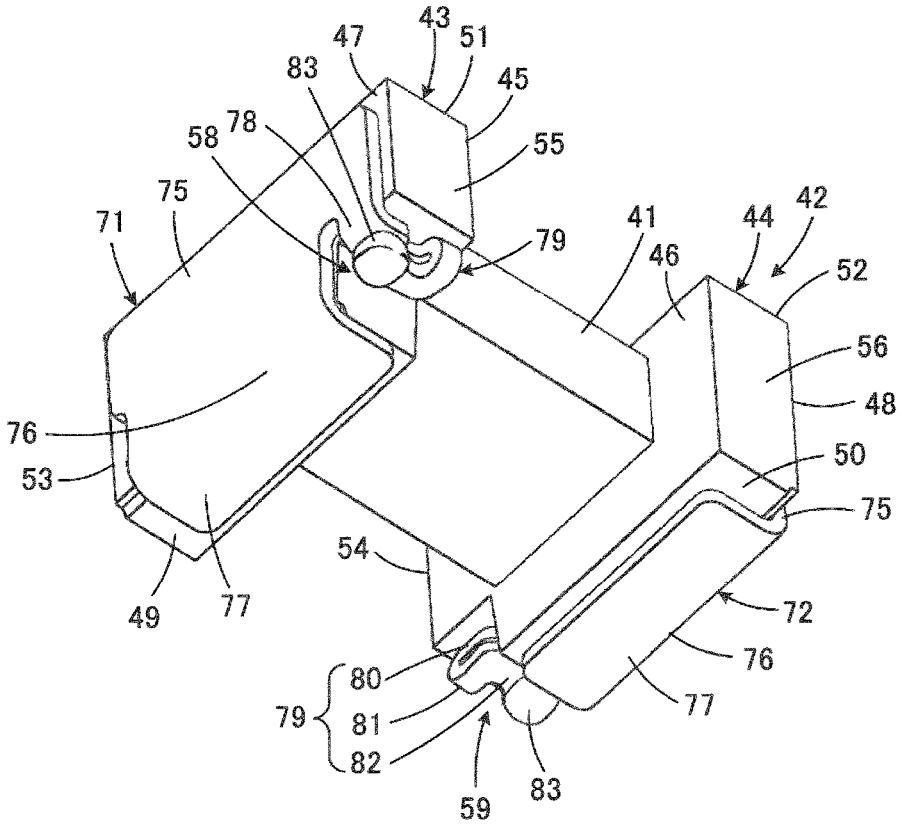

Next, a coil component according to a second embodiment of the present disclosure will be described with reference to FIGS. 6A and 6B. In FIGS. 6A and 6B, wires are not illustrated, and only the substantially drum-shaped core 42 and the terminal electrodes 71 and 72 of the coil component are depicted. In FIGS. 6A and 6B, elements corresponding to the elements illustrated in FIGS. 1A to 3 are denoted by the same reference signs to avoid repetitive description.

The coil component according to the second embodiment, which constitutes a single coil, includes a single terminal electrode provided for each of the first and second flanges 43 and 44, that is, a total of two terminal electrodes 71 and 72, and a single wire (not illustrated).

More specifically, the first flange 43 has the depression 58 in the form of a cutout located in an end portion of the side face 55 near the bottom face 49.

Likewise, the second flange 44 has the depression 59 in the form of a cutout located in an end portion of the side face 54 near the bottom face 50.

The coil component according to the second embodiment further includes the first and second terminal electrodes 71 and 72. The first terminal electrode 71 is fixed to the first flange 43 by using an adhesive. The second terminal electrode 72 is fixed to the second flange 44 by using an adhesive.

The first terminal electrode 71 includes the base 75 and the mounting part 77. The base 75 extends along the outer end face 47 of the flange 43. The mounting part 77 extends from the base 75 along the bottom face 49 of the flange 43 via the first bending part 76 that covers the edge portion where the outer end face 47 and the bottom face 49 of the flange 43 meet. Further, the terminal electrode 71 has the connection part 79 that extends from the base 75 via the second bending part 78. The connection part 79 includes the receiving part 80 and the welding part 82. The receiving part 80 receives an end portion of the wire. The welding part 82 extends from the receiving part 80 via the fold-back part 81 so as to overlap the receiving part 80, and is to be welded to an end portion of the wire. The connection part 79 is positioned within the depression 58 provided in the first flange 43.

The first terminal electrode 71 and the second terminal electrode 72 are substantially identical in shape. Accordingly, reference signs 75, 76, 77, 78, 79, 80, 81, and 82 respectively used to designate the base, first bending part, mounting part, second bending part, connection part, receiving part, fold-back part, and welding part of the first terminal electrode 71 are also respectively used to designate the corresponding first bending part, mounting part, second bending part, connection part, receiving part, fold-back part, and welding part of the second terminal electrode 72.

The second terminal electrode 72 includes the base 75 and the mounting part 77. The base 75 extends along the outer end face 48 of the flange 44. The mounting part 77 extends from the base 75 along the bottom face 50 of the flange 44 via the first bending part 76 that covers the edge portion where the outer end face 48 and the bottom face 50 of the flange 44 meet. Further, the terminal electrode 72 has the connection part 79 that extends from the base 75 via the second bending part 78 (not illustrated in FIGS. 6A and 6B). The connection part 79 includes the receiving part 80 and the welding part 82. The receiving part 80 receives an end portion of the wire. The welding part 82 extends from the receiving part 80 via the fold-back part 81 so as to overlap the receiving part 80, and is to be welded to an end portion of the wire. The connection part 79 is positioned within the depression 59 provided in the second flange 44.

One end portion of the wire (not illustrated) is connected to the connection part 79 of the first terminal electrode 71 provided in the first flange 43, more specifically, to the welding part 82 by, for example, laser welding. Likewise, the other end portion of the wire is connected to the connection part 79 of the second terminal electrode 72 provided in the second flange 44, more specifically, to the welding part 82 by, for example, laser welding. The weld ball 83 formed as a result of this laser welding is illustrated in FIGS. 6A and 6B.

Although no wire is illustrated in FIGS. 6A and 6B, in the second embodiment as well, the distal end portion of the wire protrudes from the space between the receiving part and the welding part, with the insulating coating layer remaining on the distal end portion.

Figure 7A:
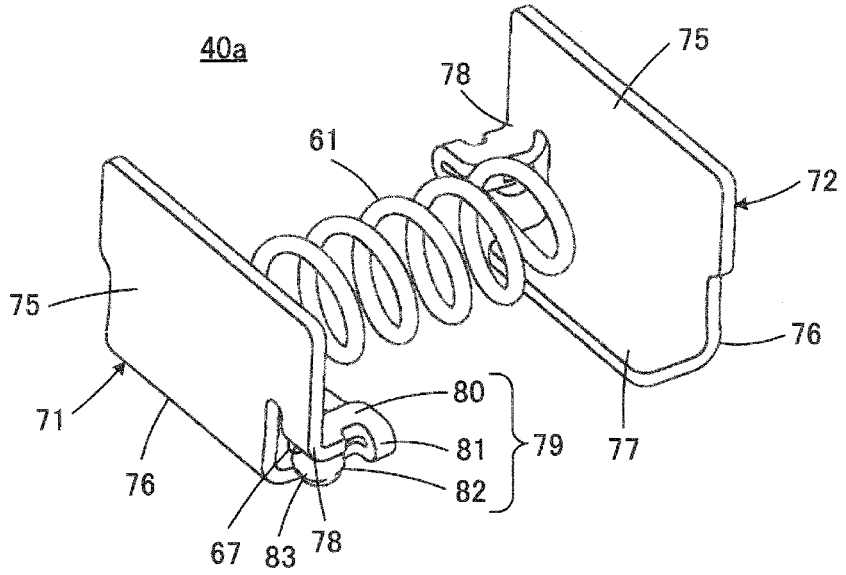
Figure 7B:
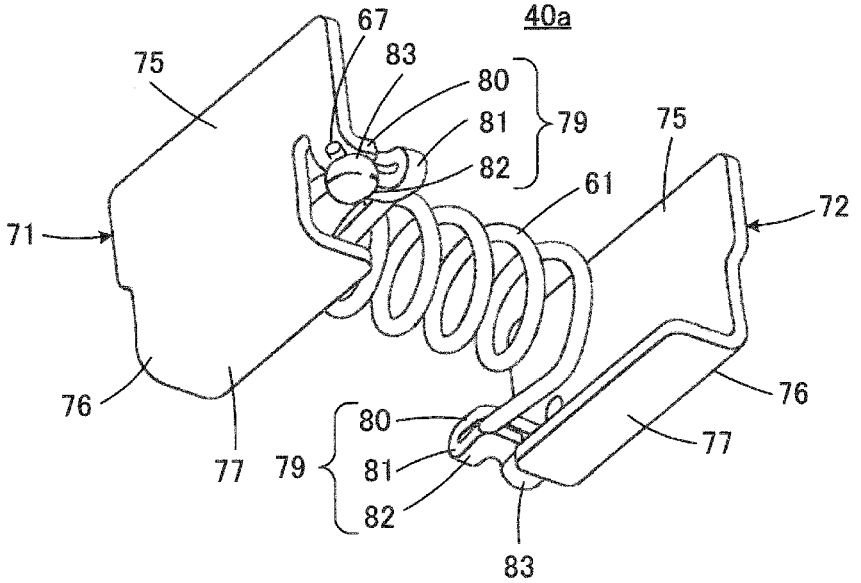
Figure 8:
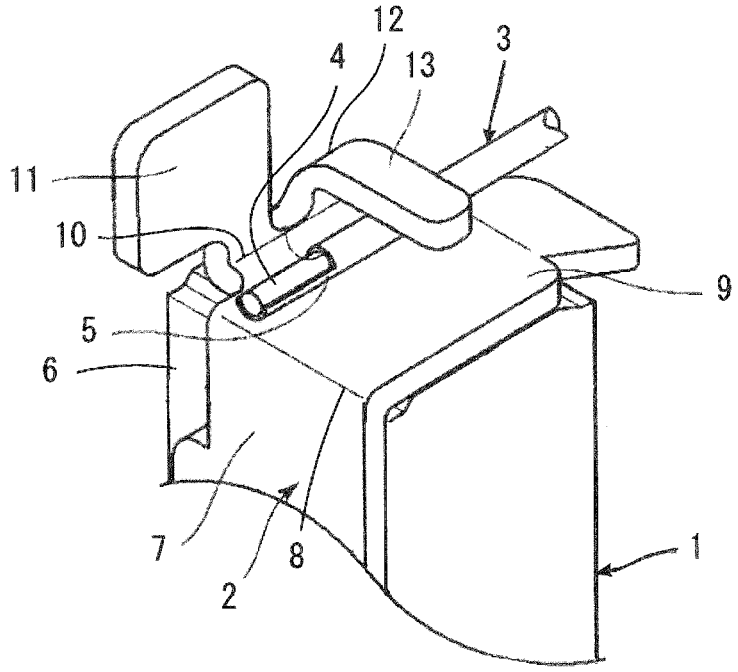
FIG. 8 is a perspective view of a flange, which constitutes a part of a core included in the coil component described in Japanese Patent No. 4184394, a terminal electrode positioned on the flange, and an end portion of a wire connected to the terminal electrode, illustrating a state prior to welding.
Figure 9:
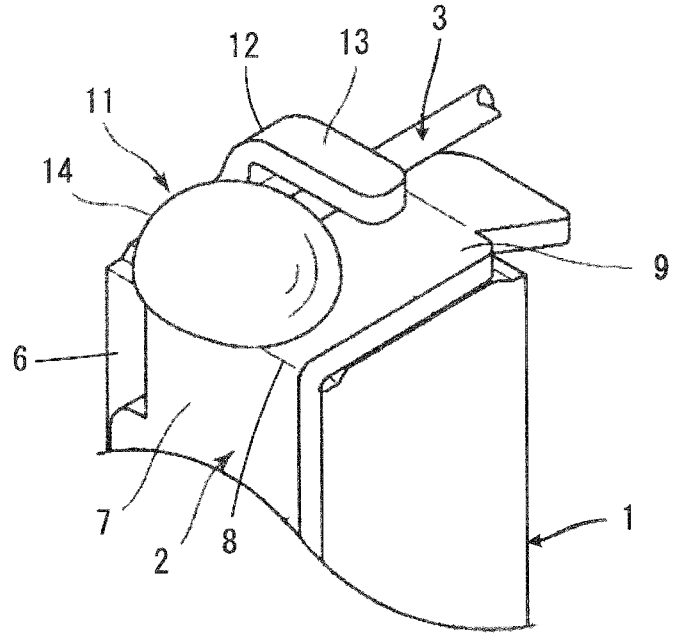
FIG. 9 is a perspective view of the portion illustrated in FIG. 8, illustrating the state of the portion after welding is performed.
Figure 10:
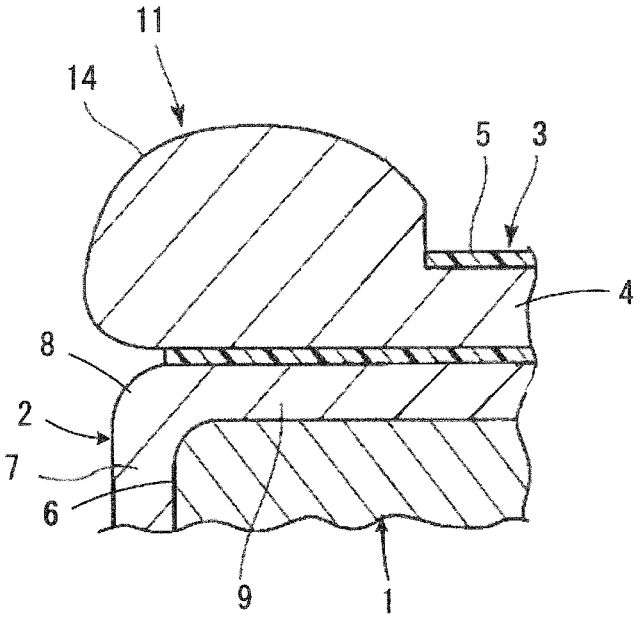
FIG. 10 is a sectional view of the portion illustrated in FIG. 9.
Figure 11:
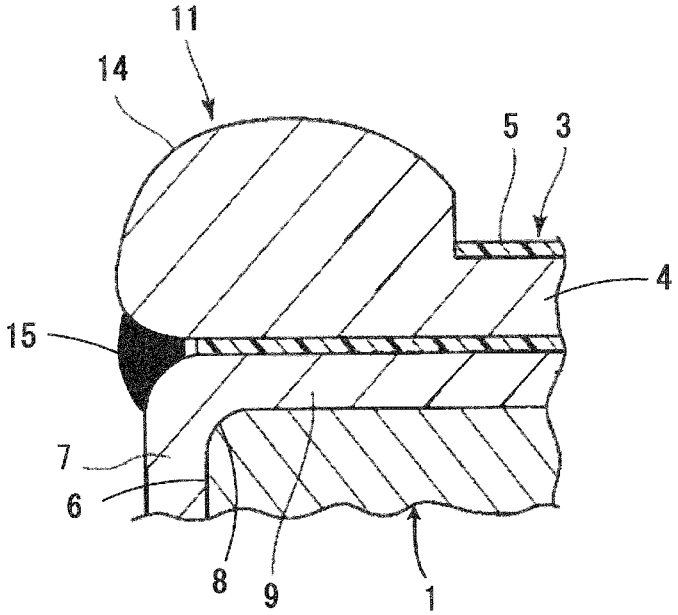
FIG. 11 is an illustration corresponding to FIG. 10 for explaining the problem to be addressed by the present disclosure.

Next, a coil component 40*a* according to a third embodiment of the present disclosure will be described with reference to FIGS. 7A and 7B. In FIGS. 7A and 7B, elements corresponding to the elements illustrated in FIGS. 1A to 3 are denoted by the same reference signs to avoid a repetitive description.

The characteristic feature of the coil component 40*a* illustrated in FIGS. 7A and 7B resides in that the coil component 40*a* does not include a core. The coil component 40*a* includes the wire 61 having a substantially helical shape. The wire 61 has a central conductor having a substantially linear shape, and an insulating coating layer that covers the peripheral surface of the central conductor. The coil component 40*a* also includes a pair of terminal electrodes 71 and 72.

The terminal electrodes 71 and 72, which are substantially identical in shape, includes the base 75, and the mounting part 77 that extends from the base 75 via the first bending part 76. Further, the terminal electrodes 71 and 72 each have the connection part 79 that extends from the base 75 via the second bending part 78. The connection part 79 includes the receiving part 80 and the welding part 82. The receiving part 80 receives an end portion of the wire 61. The welding part 82 extends from the receiving part 80 via the fold-back part 81 so as to overlap the receiving part 80, and is welded to an end portion of the wire 61.

One end portion of the wire 61 is connected to the connection part 79 of the first terminal electrode 71, more specifically, to the welding part 82 by, for example, laser welding. Likewise, the other end portion of the wire is connected to the connection part 79 of the second terminal electrode 72, more specifically, to the welding part 82 by, for example, laser welding. The weld ball 83 formed as a result of this laser welding is illustrated in FIGS. 7A and 7B.

Only a slight portion of the distal end portion 67 of the wire 61 is depicted in FIGS. 7A and 7B. In the third embodiment as well, the distal end portion 67 of the wire 61 protrudes from the space between the receiving part 80 and the welding part 82, with the insulating coating layer remaining on the distal end portion.

Although the coil component according to specific embodiments of the present disclosure has been described above, it is to be noted that the embodiments mentioned above are for illustrative purposes only, and structural portions in different embodiments may be substituted for or combined with each other.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a wire having a helical shape, the wire including a central conductor having a linear shape, and an insulating coating layer that covers a peripheral surface of the central conductor; and a terminal electrode having a connection part that is electrically connected to the central conductor in an end portion of the wire;

wherein the connection part of the terminal electrode includes a receiving part that receives the end portion of the wire, and a welding part that extends from the receiving part via a fold-back part so as to face the receiving part, wherein the wire is sandwiched between the receiving part and the welding part and the central conductor thereof is welded to the welding part in a coating layer removed portion of the wire, from which the insulating coating layer is removed, the end portion of the wire including a first portion in contact with the receiving part and a second portion extending from the first portion and having a distal end portion, the coating layer removed portion is provided only on an upper side area of the wire within the first portion and defined by the insulating coating layer of the second portion, the upper side area being opposite to a lower side area of the wire, which is in contact with the receiving portion, the insulating coating layer being present in the lower side area within the first portion of the wire, and wherein the distal end portion of the wire protrudes from a space between the receiving part and the welding part, with the insulating coating layer remaining at least on an area of the distal end portion opposite to an area in contact with the receiving part.

2. The coil component according to claim 1, wherein the insulating coating layer remains on an entire periphery of the distal end portion of the wire.

3. The coil component according to claim 1, further comprising a core having a core part and a flange provided in an end portion of the core part, wherein the wire is wound around the core part in a helical manner.

4. The coil component according to claim 3, wherein the flange includes a bottom face oriented toward a mount board when the coil component is mounted onto the mount board, and wherein the terminal electrode is disposed such that at least a part of the terminal electrode extends along the bottom face.

5. The coil component according to claim 1, wherein the insulating coating layer is made of a material withstanding a temperature that is applied to the insulating coating layer when the central conductor and the welding part are welded to each other.

* * * * *